United States Patent [19]

Zufich

[11] 4,099,657

[45] Jul. 11, 1978

[54] BACKPACK AND FRAME APPARATUS

[76] Inventor: Anthony C. Zufich, P.O. Box 333, Bodfish, Calif. 93205

[21] Appl. No.: 690,068

[22] Filed: May 26, 1976

[51] Int. Cl.[2] ..... A45F 3/10

[52] U.S. Cl. ..... 224/25 A; 280/1.5

[58] Field of Search ..... 224/25 A, 8 R, 9, 25 R, 224/5 R, 26 R, 5 A, 5 B, 8 A; 280/1.5

[56] References Cited

U.S. PATENT DOCUMENTS

| | | | |
|---|---|---|---|
| 2,133,717 | 10/1938 | Robes | 224/9 X |
| 3,355,075 | 11/1967 | Dean | 224/25 A |
| 3,516,586 | 6/1970 | Farnbach | 224/25 A |
| 3,831,827 | 8/1974 | Olson | 224/25 A |
| 3,840,162 | 10/1974 | Horenstein | 224/25 A |
| 4,015,759 | 4/1977 | Dreissigacker | 224/25 A |

*Primary Examiner*—Trygve M. Blix
*Assistant Examiner*—Jerold M. Forsberg

[57] ABSTRACT

A backpack and frame apparatus comprising a pair of tubular side bars and lateral cross members for supporting the backpack and upper terminus of the shoulder harness. A supporting belt adapted to be coupled about the user's waist and hips includes downwardly projecting panels disposed on diametrically opposed sides of the belt and adapted to lie substantially below the waist of the user. A supporting frame is coupled to the lower extensions of the belt and extends about the rear of the user, the support frame being reciprocally coupled to a pack frame cross member to provide independent movement between the pack frame and the support frame.

9 Claims, 7 Drawing Figures

BACKPACK AND FRAME APPARATUS

BACKGROUND OF THE INVENTION

1. Field of the Invention

The present invention generally relates to a pack frame and sack which is adapted to be utilized by campers, hunters, fishermen, climbers and the like and, more particularly, to those backpacks which utilize the hips of the user to support the load.

2. Prior Art

There are numerous pieces of prior art which disclose backpacks, pack frames and related apparatus. One of the most pertinent pieces of prior art discloses a pack frame and sack therefor which has a primary object to provide a pack frame by which a major portion of the load is carried by the hips of the user. In this device, the hip strap is padded and is tightened about the hips of the user in a position which is intended to engage the hip bones. The load carried by the sack is transferred to the hip strap at each side rather than primarily to the back or shoulders of the user. In this device, an L-shaped hip tube having an upright post and a forward extending arm is mounted adjacent the lower end of side bars and extends forwardly along the hip of the user. A joint for connecting each hip tube and the side bars is adjustable upwardly and downwardly along the side bar while a series of differently angled holes in the post of the hip tube permits the angle of the hip tube to be varied through the use of a removeable pin. The hip strap includes an outer strap and inner padding and is tightened about the hips of the user while a pin carried in each side of the hip strap extends through a grommet at the lower end of the corresponding shoulder strap and through the corresponding hip tube so that the weight of the pack is concentrated at the sides of the hips of the user rather than on the shoulder. The inadequacies of this device are obvious. Since the hip tubes are attached rigidly to the frame of the pack on one end, and to a single point on the belt at the other, that weight of the pack which is not being carried by the shoulders is brought to bear on a small area over each hip. Since the hips rise and fall in walking, friction occurs between the belt and the hip.

Another backpack and frame dislosed by the prior art utilizes a hip belt which is disposed about the waist of the wearer. The pack frame has two substantially vertical side bars and remaining sections of tubing and tees which form the side and transverse connectors of the frame. At least some of the joints of the tubing sections and tees are detachable so that the frame may be disassembled. The hip belt is disposed about the waist of the wearer and holds the bottom of the frame in a vertical position. The problem which arises by use of this device is apparent in its design. An attempt is made to support the load about the waist of the user, but there is no provision for support and independence between the load and the user.

Another pack frame and assembly which is disclosed by the prior art is adapted to be carried upon a person's back through the use of shoulder straps and having hip-engaging means thereon to bear on a portion of a person's hips so as to carry the majority of the load thereagainst. The hip-engaging means includes a backplate assembly having a pair of anchor plates connected to respective ones of the support tube members which constitute the primary vertical support of the pack. The belt assembly is adapted to be placed about the waist of the user above the hip line, the full weight of the pack frame being centered at the waist of the user on opposite sides thereof as well as the user's shoulders. As with the devices described hereinabove, the inability to provide independence of movement between the user and the load renders the prior design inadequate.

The present invention substantially resolves the problems which are inherent in the devices disclosed by the prior art. A contoured belt is adapted to be disposed about the waist of the user, the belt including downwardly extending load support panels which are adapted to be coupled to the load at a point which is substantially below the waist. A rigid support member or yoke is coupled to the lower portions of the supporting extensions and extends about the rear of the user. The pack frame is pivotally coupled to the yoke in a manner which will permit the user to have normal rotational hip action without being unduly retarded by the load being carried. In this manner, the support of the load at a point substantially below the waist of the user provides for better distribution of the load to the hips and the non-rigid coupling between the yoke and the frame provides for independence of movement between the user and the load.

SUMMARY OF THE INVENTION

The present invention comprises a backpack and frame assembly which substantially improves the ability to carry a load thereon. A pair of side frame members are pivotally coupled to a yoke which is adapted to be disposed about the rear of the user. The yoke is a substantially semi-circular support frame which is adapted to move independently of the pack frame. By pivotally coupling the support frame and yoke to the pack frame, the hips and legs of the user will be free to move in a normal manner independent of the load which is being carried by the pack frame.

A supporting belt is disposed about the waist of the user, the belt having downwardly extending panels or gussets along the hips of the user. The downwardly extending supporting panels each include appropriate couplings which are disposed substantially below the waistline of the user. The couplings lie on opposite sides of the user and are in substantially the same plane. The support frame and yoke is joined to the coupling of the support belt. By joining the support frame-yoke to the supporting belt by means of gussets which allow for attachment at a point which is substantially below the waistline of the user, the full load which is being supported by the pack frame will be distributed along the hips of the user in a manner which cannot be obtained where gussets are not used and the load is attached directly to the belt. The pack frame is pivotally coupled to the support frame-yoke in a manner which will permit the support frame-yoke to rock or otherwise have independence of movement with respect to the pack frame. When the user moves in a normal manner, his hips will tend to rock and thereby transfer equal motion to the support frame-yoke. The pack frame is held in place by shoulder straps and therefore can be maintained in a stable position irrespective of the rocking movement which is transferred to the yoke by the ambulatory motion of the user.

It is therefore an object of the present invention to provide an improved backpack and frame apparatus.

It is another object of the present invention to provide a backpack and frame apparatus which isolates the user's movement from the supported load.

It is still another object of the present invention to provide a backpack and frame apparatus which fully distributes the supported load about the hips of the user.

It is still yet another object of the present invention to provide a backpack and frame apparatus which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE PRESENTLY PREFERRED EMBODIMENT

Figure 1:
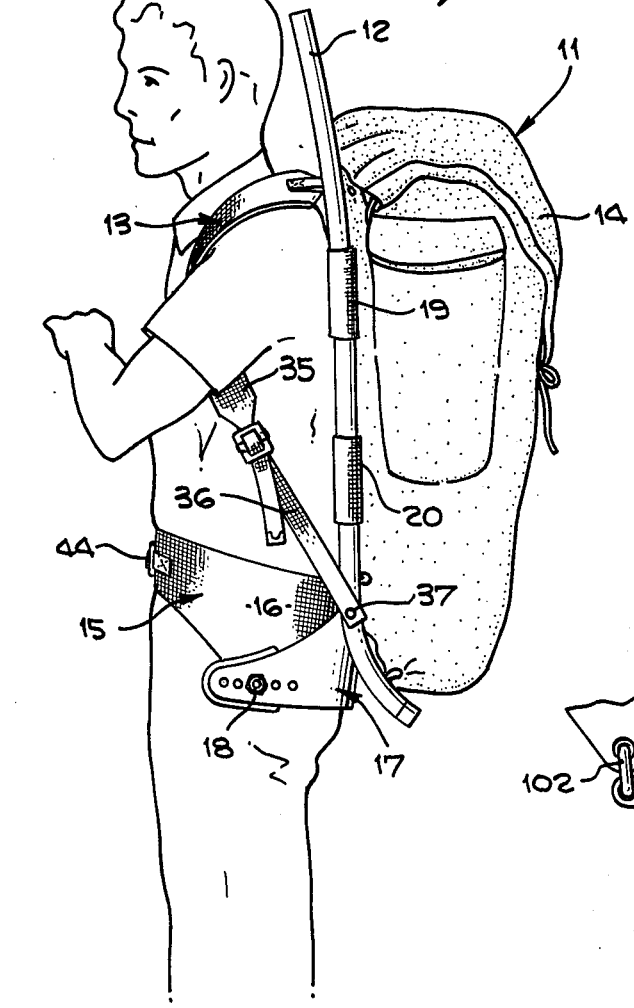
FIG. 1 illustrates a form of the present invention backpack frame apparatus on a user.

Referring now to FIG. 1, an understanding of the basic relationship between the present invention backpack and frame apparatus and the user can be best seen. User 10 has disposed on his back the present invention backpack and frame assembly 11. Backpack and frame assembly 11 comprises a pair of pack frame side members 12 which are laterally coupled in a manner which will be described hereinbelow. Shoulder straps 13 are fixedly joined to backpack and frame assembly 11 to provide upper support for the load which is carried in backpack 14. User 10 has disposed about his waist a supporting belt 15. Belt 15 has disposed along each side thereof downwardly extending support sections or gussets which extend substantially below the waistline of user 10. Support frame 17 extends about the rear of user 10 and is coupled to the lower extensions of support gussets 16 by conventional coupling means such as the nut and bolt illustrated by reference numeral 18. As will be described hereinbelow, support frame 17 is pivotally coupled to backpack and frame assembly 11 in a manner which will permit user 10 to freely move without being unduly retarded by the load held in backpack 14. Since typical movement of user 10 will require undulating and reciprocal pivoting of the hips, supporting belt 15 and frame 17 will simultaneously adopt the identical movement. By pivotally coupling support frame 17 to backpack and frame assembly 11, each of the pivotally coupled members 17 and 11 will move independent of one another while providing vertical support for the load held by backpack 14. To provide further distribution of the load across the back of user 10, webbing 19 and 20 is stretched between back frame side members 12 in a position which will conform to the supporting surfaces of the back of user 10. In addition, webbing 19 and 20 will provide air space between the back of user 10 and backpack 14 for comfort as well as to protect user 10 from any sharp edge or object which may be stored in backpack 14.

Figure 2:
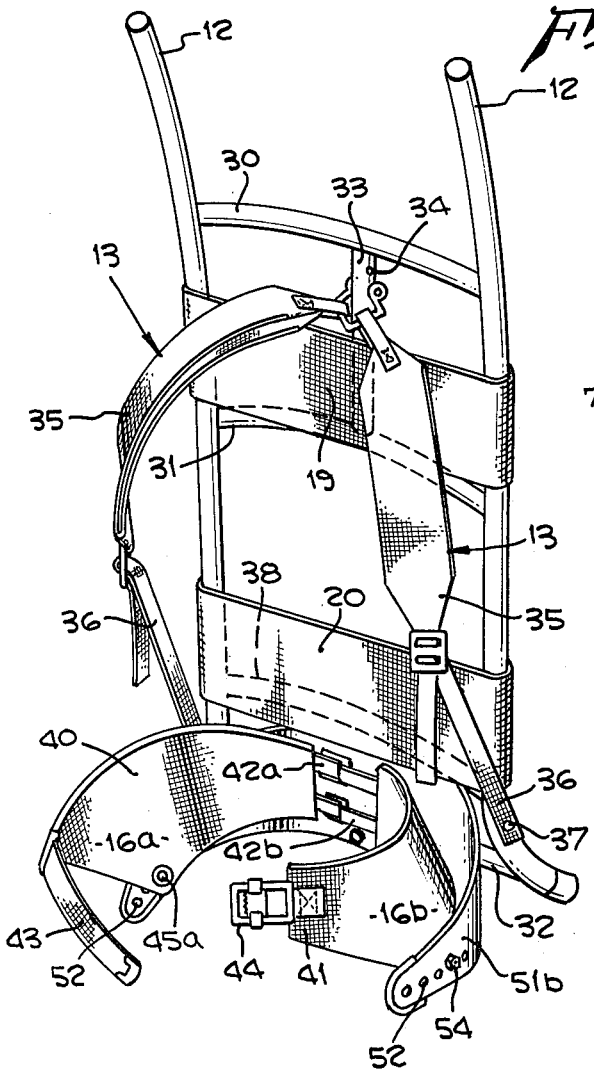
FIG. 2 illustrates a perspective view of a preferred form of a backpack and frame apparatus in accordance with the present invention.
Figure 3:
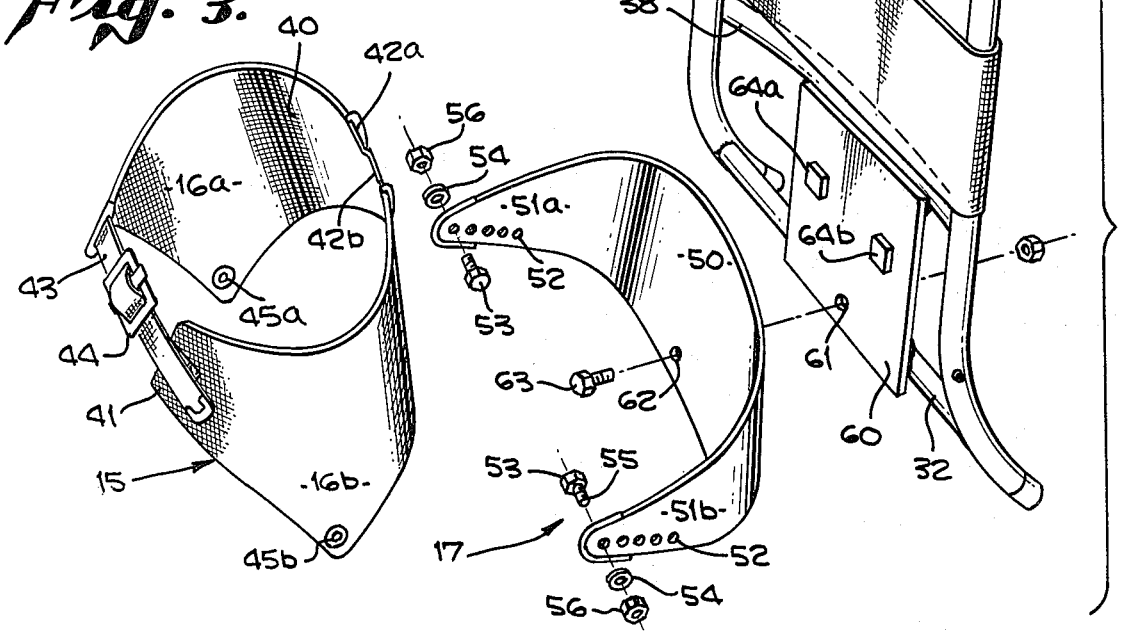
FIG. 3 illustrates an exploded, assembly view of the supporting hip belt, yoke and pack frame shown in FIG. 2.

An understanding of the construction of a preferred form of the present invention can be best seen by reference to FIG. 2 and FIG. 3. Backpack and frame assembly 11 comprises a pair of frame side members 12 which are disposed in parallel spaced relation to each other. Lateral cross members 30 and 31 are coupled intermediate frame side members 12 in a manner which will maintain rigidity of frame 11 and maintain the appropriate spacing between side members 12. Although any conventional coupling may be utilized, lateral cross members 30, 31 and 32 are typically welded to frame side members 12 if appropriate materials are used. Where it is desired to produce a form of the present invention which is lightweight, side members 12 and lateral cross members 30, 31, 32 and 33 are preferably formed of lightweight tubing such as aluminum. Where the elements of frame assembly 11 are fabricated of materials which cannot be welded, appropriate mechanical couplings can be substituted therefor.

Shoulder strap support tube 33 is coupled to intermediate lateral cross members 30 and 31. Support tube 33 includes aligned, vertical adjustment apertures 34 in spaced relation to one another. Shoulder straps 13 include a padded section 35 which is adapted to be disposed across the shoulders of user 10, padded sections 35 being coupled to the lower portions of frame side members 12 through the use of adjustable straps 36. Straps 36 are joined to side members 12 by grommets and clevis pins or any other conventional mechanical coupling means 37 at a position which is substantially at the waist of the user 10. The termini of padded sections 35 opposite to straps 36 are coupled to a clevis which is attached to the shoulder strap support tube by means of a clevis pin that passes through one of the adjustment apertures 34 to conform to the size requirement of user 10. As was described in connection with FIG. 1, webbing 19 and 20 is laterally disposed between pack frame side members 12 to cushion the load against the back of user 10 and provide an air space between user 10 and backpack 14. Additional comfort may be created by increasing the curvature of lateral cross member 31 to account for the typical curvature which would occur at the mid-section of the back of user 10. As will be described hereinbelow, lateral cross member 32 does not come in contact with the user 10 and therefore is substantially straight as can be best seen in FIG. 3.

Primary support for the present invention backpack and frame assembly 11 is derived from support belt 15 which can be best seen in FIG. 2 and FIG. 3. Support belt 15 is typically fabricated of a pair of complementary sections 40 and 41 which are disposed on either side of user 10 along the user's hips. Support belt 15 is preferably fabricated from an interlaced, mesh structure although a padded foam construction can be utilized. Use of a mesh structure will combine the necessary strength with means for cooling the areas of the user which are covered by belt 15. As can be best seen in FIG. 2, sections 40 and 41 are joined at the rearward juncture thereof by straps 42*a* and 42*b*. Although straps 42*a* and 42*b* provide for increased flexibility of belt sections 40 and 41, it is obvious that a unitary structure could be utilized to implement supporting belt 15. A conventional strap 43 is securely affixed to supporting section 40, a mating buckle 44 being affixed to supporting section 41 to provide for a mating assembly such as that shown in FIG. 3. Belt assembly 43 and 44 are adapted to be secured about the waist of the user 10 in a secure manner to provide the base for supporting the loads held by the present invention backpack frame assembly 11.

Supporting sections 40 and 41 each include downwardly extending panels 16*a* and 16*b* which comprise gussets which extend along the user's hips. The apex of each gusset 16*a* and 16*b* has a complementary aperture thereto and incorporates grommets 45*a* and 45*b* therein to provide the means for coupling the backpack frame assembly 11 thereto. As can be best seen in FIG. 3, the tapered profile of gussets 16*a* and 16*b* provide means for distributing any load thereon about substantially the full periphery of supporting belt 15. The significance of load distribution will be explained in detail hereinbelow.

A preferred form of the present invention utilizes a supporting frame 17 to couple frame assembly 11 to supporting belt 15. Support frame 17 has a substantially planar rear section 50 which depends at either end thereto into tapered flanges 51*a* and 51*b*. The termini of flanges 51*a* and 51*b* are substantially parallel to each other and each have a respective set of adjustment apertures 52 which are adapted to be aligned with grommets 45*a* and 45*b*. The size of user 10 will determine the appropriate adjustment and appropriate coupling means are used to secure support frame 17 to gussets 16*a* and 16*b* at grommets 45*a* and 45*b* respectively. Typical coupling means are shown in FIG. 3 wherein a suitable bolt 53 is inserted through grommet 45*b* and the mating adjustment aperture 52, a securing washer 54 being disposed over the shank of bolt 53 and a cotter pin 56 disposed through orifice 55. It is clear that although the use of bolt 53 with a mating cotter pin 56 is a suitable means for coupling supporting belt 15 and supporting frame 17, other suitable mechanical coupling devices can be used.

As set forth hereinabove, an objective of the present invention is to provide independence of movement between support frame 17 and the portion of backpack frame assembly 11 which supports the main load. A form of the present invention is shown in FIG. 3. A substantially flat, rigid plate 60 is secured between lateral cross members 32 and 38 substantially intermediate pack frame side members 12. An orifice 61 is disposed through plate 60 and is adapted to be aligned with a mating orifice 62 disposed through rear panel 50 of supporting frame 17. A suitable coupling 63 is disposed through orifice 61 and orifice 62 which secures supporting frame 17 to plate 60 while permitting support frame 17 to reciprocally move about the axis of coupling 63. In this manner, any load held by backpack and frame assembly 11 will be vertically supported at gussets 16*a* and 16*b* through coupling 63 while simultaneously permitting support frame 17 to adopt the rocking motion which would necessarily result when user 10 moves in a conventional ambulatory manner. Since substantial loads can be placed upon plate 60, means must be provided to insure that the relative movement of plate 60 and rear panel 50 against one another will be unhindered, e.g., through the use of bearings or other appropriate non-frictional surfaces. The form of the present invention shown in FIG. 3 illustrates the use of a pair of Teflon pads 64*a* and 64*b* mounted upon the surface of plate 60. Since the relative movement of plate 60 and rear panel 50 will constitute a reciprocating movement about the axis of coupling 63, the portions of plate 60 and rear panel 50 which are in contact will have Teflon pads 64*a* and 64*b* intermediate thereto thereby substantially eliminating the frictional contact which would ordinarily be presented. Although the use of Teflon pads is a preferable form for implementing the present invention, it is clear that the function of pads 64*a* and 64*b* can be implemented through the use of a suitable structure for reducing friction such as bearings, rollers or other conventional devices which will facilitate the movement of the planar surface against the frame bearing surface.

Figure 4:
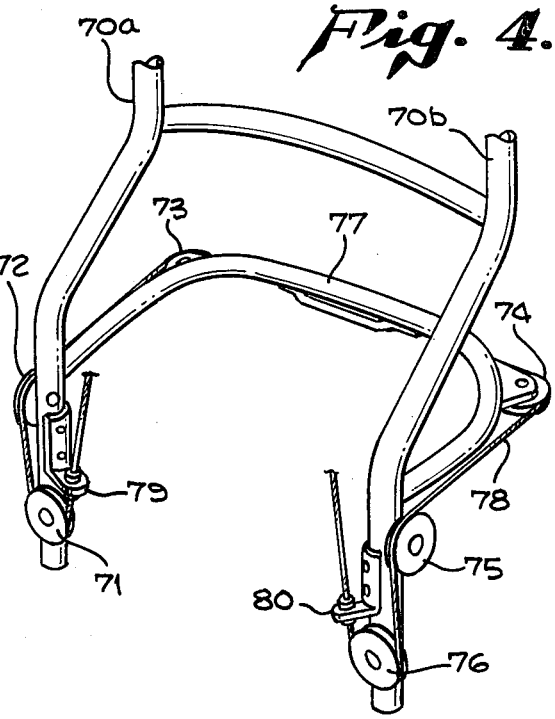
FIG. 4 illustrates an alternative form for the coupling between the pack frame and supporting belt utilizing a cable and pulley assembly.

A primary object of the present invention is to give the user 10 independence of movement from the pack assembly. In the form of the present invention described in connection with FIGS. 1 - 3, inclusive, supporting frame 17 was pivotally coupled to plate 60 to meet this objective. FIGS. 4 - 7, inclusive, illustrate alternative means for implementing this objective of the present invention. Referring now to FIG. 4, an alternative form of the present invention is illustrated. Pack frame side members 70*a* and 70*b* are deflected or extended forward in the vicinity of the waist of user 10. The terminus of each of the side members 70*a* and 70*b* are deflected downwardly in a manner which would place them substantially vertical and adjacent grommets 45*a* and 45*b* is gussets 16*a* and 16*b* respectively. Pulleys 71, 72, 73, 74, 75 and 76 are mounted along side members 70*a* and 70*b* and a substantially U-shaped cross member 77 in the manner shown in FIG. 4. U-shaped lateral cross member 77 fits about the user and provides means for guiding cable 78 thereabout. Cable 78 is disposed through cable guides 79 and 80 and is terminated at either end by coupling devices which can be secured to gussets 16*a* and 16*b* at grommets 45*a* and 45*b*. Coupling devices 81 and 82 are secured to grommets 45*a* and 45*b* respectively. When couplings 81 and 82 are secured to grommets 45*a* and 45*b*, the loads mounted to side members 70*a* and 70*b* will put cable 78 in tension, the load being imposed on supporting belt 15 at gussets 16*a* and 16*b*. Any rocking or reciprocal movement which is caused by the ambulatory motion of user 10 will be transmitted to cable 78 in a manner which will cause it to move over pullies 71 - 76, inclusive, in a consistent manner. Side frames 70*a* and 70*b* can move independently of supporting hip belt 15, the relative movement therebetween being compensated for by the movement of cable 78 over the pulley assembly.

Figure 5:
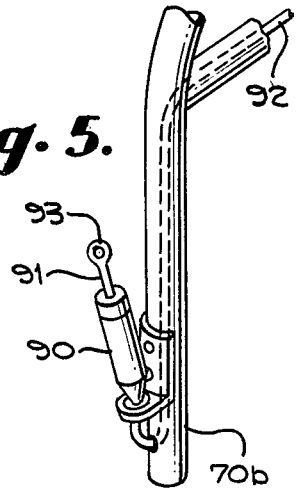
FIG. 5 illustrates an alternative form for the coupling between the pack frame and supporting belt utilizing hydraulic cylinders.

Referring now to FIG. 5, another alternative structure for providing the independent support for backpack and frame assembly 11 can be best seen. In place of the pulley and cable assembly shown in FIG. 4, suitable hydraulic cylinders 90 are mounted upon pack frame side members 70*a* and 70*b*. Although only a single sample is shown in FIG. 5, it is clear that the complementary structure is mounted upon frame side members 70*a*. Hydraulic cylinder 90 is a conventional device which utilizes piston 91 to impose force on the hydraulic cylinder and creates a compressive force on the hydraulic fluid which flows through tubing which will couple the cylinders 90 to one another. Typically, the hydraulic tubing 92 can be disposed through lateral cross member 77. Coupling 93 is secured to gusset 16*b* and a complementary coupling secured to gusset 16*a*. Reciprocal movement of the hips of the user will cause reciprocal hydraulic pressure to be imposed upon the hydraulic fluid thereby establishing independence of movement between the user and the pack frame.

Figure 6:
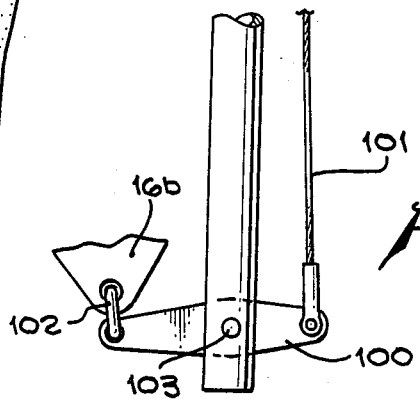
FIG. 6 illustrates an alternative form of the coupling between the pack frame and the support belt utilizing a lever and cable assembly.

Referring now to FIG. 6, another alternative embodiment to that shown in FIG. 4 can be best seen. A lever arm 100 is pivoted about an appropriate point on the lower terminus of side frame 70*b*, one end of lever 100 having cable 101 secured thereto, the second end of lever arm 100 being coupled to grommet 45*b* of gusset 16*b* by clevis 102. Cable 101 can be directed about pulleys in the manner shown with respect to pullies 71, 72, 73, 74, 75 and 76 (FIG. 4) or directed across a lateral cross member intermediate side frames 70*a* and 70*b* in a suitable manner. The load held by frame 70*a* and 70*b* will be supported at gusset 60*b*, the independence of movement between supporting belt 15 and the pack frame being accomplished through the reciprocal movement of lever 100 about pivot 103. Although only a single element was shown in FIG. 6, it is clear that a complementary lever system is affixed to side members 70*a* and secured to gusset 16*a* in the manner shown in FIG. 6.

Figure 7:
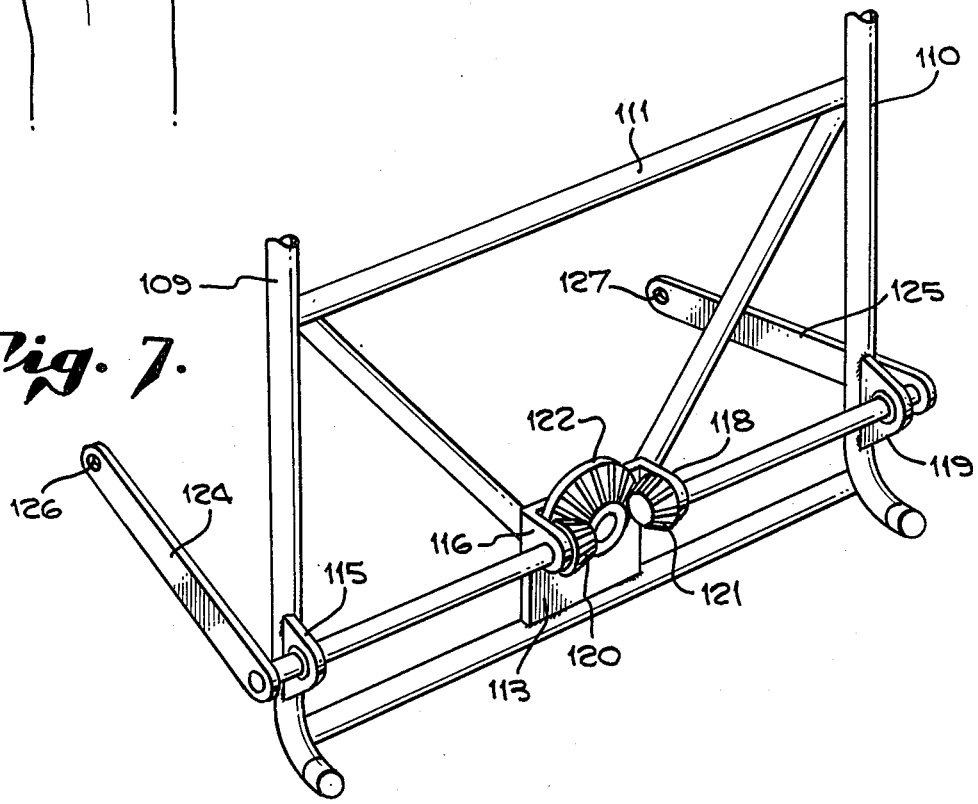
FIG. 7 illustrates an alternative form for coupling the pack frame to the support belt utilizing beveled gear gimbaling.

Another alternative form of the means to isolate the backpack frame 11 from the user is shown in FIG. 7. A pair of pack frame side members 110 are vertically disposed in the manner shown in FIGS. 1 – 3, inclusive. Lateral cross members 111 and 112 maintain side members 110 in parallel spaced relation to one another and provide the lateral strength to support the loads which will be incurred. Although it is not shown, side members 109 and 110 utilize shoulder straps in the same manner as illustrated in FIG. 1. A vertical brace 113 is disposed upwardly from lateral cross member 112 intermediate side members 109 and 110. Axle 114 is suitably journeled between brackets 115 and 116, axle 117 being suitabley journeled between brackets 118 and 119 respectively. Brackets 115 and 119 are secured to side members 109 and 110 respectively. Brackets 116 and 117 depend from vertical brace 113. The inner terminus of axles 114 and 117 are secured to a pair of beveled gears 120 and 121 respectively. Beveled gears 120 and 121 are engaged with a circular beveled gear 122 which is rotatably affixed to vertical brace 113 and adapted to rotate about its axis 123. The second end of axles 114 and 117 are secured to lever arms 124 and 125 respectively. Apertures 126 and 127 are disposed at the ends of lever arms 124 and 125 respectively and are adapted to engage grommets 45*a* and 45*b* in gussets 16*a* and 16*b* respectively. The couplings intermediate lever arms 124 and 125 and gussets 16*a* and 16*b* are pivotal permitting lever arms 124 and 125 to apply rotational torque to axles 114 and 117 in response to any vertical deflection of gussets 16*a* and 16*b*.

In operation, ambulatory movement of user 10 will necessarily transmit a rocking motion to gussets 16*a* and 16*b* of supporting belt 15. In the form of the invention shown in FIG. 7, the upward and downward deflection of gussets 16*a* and 16*b* will be transmitted to levers 124 and 125. The upward and downward deflection of gussets 16*a* and 16*b* will be transmitted to levers 124 and 125. The transmission of the reciprocating movement to axles 114 and 117 will cause alternate rotation of axles 114 and 117, the complementary motion being transmitted through the use of mating beveled gear 122. By this configuration, the movement of user 10 is isolated from backpack and frame assembly 11 in a manner which will not retard user 10 and will thereby facilitate the use of the present invention assembly.

It can therefore be seen that the present invention provides a substantial improvement over the backpack assemblies which are disclosed by the prior art. By providing means to suspend the loads of the backpack from points substantially below the waist of the user, and by distributing that load in an efficient manner about the waist and the hips of the user, any discomfort which would normally occur is substantially eliminated. In addition, by providing independence of movement between the backpack frame and the user, the load does not act in any manner to retard the free movement of the user while simultaenously permitting the load to be supported in a comfortable manner.

I claim:

1. A backpack and frame apparatus comprising:

(a) a frame comprising a pair of side bar members and upper and lower lateral cross members connecting said side bar members;

(b) an upper support tube coupled intermediate a pair of upper cross members, said upper support tube with vertically oriented adjustment apertures in spaced relation to each other and aligned parallel to said side members;

(c) a pair of shoulder straps, the upper ends thereof being coupled to vertically aligned adjustment apertures;

(d) a hip belt including an engagement member adapted to encircle the waist of a user, said hip belt including a pair of gussets extending downwardly from diametrically opposed sides of said hip belt, the lower projection of said gussets being substantially below said engagement member and adapted to be adjacent the hips of the user and be diametrically opposed to one another;

(e) means for attaching the lower ends of said shoulder straps to respective ones of said side bar members substantially adjacent said lower lateral cross members;

(f) a supporting frame comprising a substantially planar rear member and side members extending from either edge thereof, said side members being deflected from said planar rear member parallel to respective ones of said gussets, the termini of said side members being in parallel spaced relation to each other and including a plurality of aligned adjustment apertures, a respective pair of adjustment apertures in each of the side members of supporting frame being coupled to the lower projection of the adjacent gussets of said hip belt diametrically opposed to one another;

(g) lower bearing surfaces secured between lateral lower cross members intermediate said pairs of said bar members; and (h) means for pivotally coupling the planar rear member of said supporting frame to said lower bearing surfaces about an axis substantially perpendicular to said planar rear member whereby said hip belt and supporting frame are free to reciprocally move about said axis independent of said frame.

2. A backpack and frame apparatus as defined in claim 1 wherein the side members extending from said planar rear member are deflected in an arc and adapted to be substantially parallel to respective ones of said gussets.

3. A backpack and frame apparatus as defined in claim 1 wherein means for pivotally coupling comprises an aperture centrally disposed in said planar rear member and said lower bearing surface, and coupling means disposed through said apertures along the axis lying perpendicular to said planar rear member whereby said planar rear member will rotate with respect to said lower bearing surface about the axis perpendicular to said planar rear member.

4. A backpack and frame apparatus as defined in claim 1 wherein said gussets are tapered downwardly from said hip belt whereby a load coupled to the lower projection of said gussets is distributed uniformly about said hip belt.

5. A backpack and frame apparatus comprising:

(a) a frame including a pair of side bar members and upper and lower lateral cross members connecting said side bar members;

(b) an upper support tube coupled intermediate a pair of upper cross members intermediate said side bar members;

(c) a pair of shoulder straps, the upper ends thereof attached to said support tube;

(d) hip belt means for encircling the waist of a user, said hip belt means including downwardly extending panels adapted to lie along the hips of the user, each of said panels including grommets for attachment thereto, said grommets being diametrically opposed to one another;

(e) means for attaching the lower ends of said shoulder straps to respective ones of said side bar members substantially adjacent the waist of the user;

(f) a supporting frame comprising a substantially planar rear member and side member extending on either side thereof, said side members being deflected forwardly and inwardly from said planar rear member substantially parallel to the side panels of said hip belt means, the termini of said side members being in parallel spaced relation to each other coupled to respective ones of said grommets;

(g) a lower bearing surface secured to lateral lower cross members intermediate said pair of side bars; and (h) means for pivotally coupling the planar rear member of said supporting frame to said lower bearing surface about an axis which is substantially perpendicular to said planar rear member whereby said hip belt means and supporting frame are free to reciprocally move about said axis independent of said frame.

6. A backpack and frame apparatus as defined in claim 5 further including friction reducing means for reducing the friction between said planar rear member and said lower bearing surface, said friction reducing means being disposed intermediate said planar rear member and said lower bearing surface.

7. A backpack and frame apparatus as defined in claim 6 wherein said friction reducing means comprises Teflon pads affixed to said lower bearing surface and adapted to contact the planar rear member of said supporting frame.

8. A backpack and frame apparatus as defined in claim 5 wherein said hip belt means comprises a belt to encircle the waist of a user and a pair of gussets depending downwardly from said belt on diametrically opposed sides thereof, said grommets being symmetrically coupled to said gussets of the lower portions thereof.

9. A backpack and frame apparatus as defined in claim 8 wherein said gussets are uniformly tapered downwardly from said belt, a load coupled to said grommets being uniformly distributed about said belt.

* * * * *